US010676969B2

(12) United States Patent
Kim

(10) Patent No.: US 10,676,969 B2
(45) Date of Patent: Jun. 9, 2020

(54) VEHICLE DOOR HANDLE

(71) Applicant: HYUNDAI MOTOR COMPANY, Seoul (KR)

(72) Inventor: Ho Hyung Kim, Incheon (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 263 days.

(21) Appl. No.: 15/352,277

(22) Filed: Nov. 15, 2016

(65) Prior Publication Data

US 2018/0094459 A1 Apr. 5, 2018

(30) Foreign Application Priority Data

Oct. 4, 2016 (KR) ..... 10-2016-0127657

(51) Int. Cl.

| | |
|---|---|
| ***E05B 77/04*** | (2014.01) |
| ***E05B 77/36*** | (2014.01) |
| ***E05B 77/42*** | (2014.01) |
| ***E05B 85/16*** | (2014.01) |
| *E05B 77/06* | (2014.01) |

(52) U.S. Cl.

CPC ..... *E05B 77/04* (2013.01); *E05B 77/36* (2013.01); *E05B 77/42* (2013.01); *E05B 85/16* (2013.01); *E05B 77/06* (2013.01)

(58) Field of Classification Search

CPC ..... E05B 77/04; E05B 85/16; E05B 77/42; E05B 77/36; E05B 77/06

See application file for complete search history.

(56) References Cited

U.S. PATENT DOCUMENTS

| | | | | |
|---|---|---|---|---|
| 6,460,904 | B1 * | 10/2002 | Stapf | E05B 85/12 292/336.3 |
| 6,572,159 | B2 * | 6/2003 | Lambertz | E05B 77/42 16/412 |
| 6,598,913 | B2 * | 7/2003 | Meinke | E05B 85/107 292/336.3 |
| 7,210,716 | B2 * | 5/2007 | Mueller | E05B 77/06 292/336.3 |
| 2014/0035310 | A1 * | 2/2014 | Ozaki | E05F 5/025 296/50 |

FOREIGN PATENT DOCUMENTS

| | | |
|---|---|---|
| JP | 2014-040711 A | 3/2014 |
| KR | 2005-0077023 A | 7/2005 |

* cited by examiner

*Primary Examiner* — Kristina R Fulton
*Assistant Examiner* — Thomas L Neubauer
(74) *Attorney, Agent, or Firm* — McDonnell Boehnen Hulbert & Berghoff LLP

(57) ABSTRACT

The present disclosure relates to a vehicle door handle that prevents the door from opening in the event of a collision, and in particular, a side collision. The door handle also minimizes the sound attendant with the return of the door handle to a closed position. The handle for the vehicle door includes: a handle base having a rotatable base lever; and a handle grip connected to the handle base, wherein the base lever includes a shaft and a damping unit installed in the shaft, and wherein the damping unit is configured to buffer the rotation speed of the shaft.

7 Claims, 6 Drawing Sheets

VEHICLE DOOR HANDLE

CROSS-REFERENCE TO RELATED APPLICATION

This application claims the benefit of priority to Korean Patent Application No. 10-2016-0127657, filed on Oct. 4, 2016 in the Korean Intellectual Property Office, the disclosure of which is incorporated herein in its entirety by reference.

BACKGROUND OF THE INVENTION

Field of the Invention

The present disclosure relates to a vehicle door handle, and more particularly, to a handle capable of preventing the door from opening in the event of a side collision, and minimizing the sound that occurs when the door handle returns to a closed position.

Description of the Related Art

In general, a vehicle door may include a door-locking mechanism for accomplishing the opening and closing of door, and the door-locking mechanism may be operated by an outside handle or an inside handle installed in the vehicle door.

The outside handle for the vehicle door may include a handle base installed in a panel of the vehicle door, and a handle grip pivotably affixed to the handle base.

A base lever may be rotatably installed in the handle base, and the base lever may be connected to a latch of the door-locking mechanism through an operation rod or an operation cable, such that the latch may be driven by the rotation of the base lever. A return spring may be installed in the base lever, and, if operating force is released, the base lever may be returned to an original position by a return spring. In addition, the base lever may have a balance weight, and the position of the base lever may be maintained stably by the balance weight at the time of occurrence of external impact.

The handle grip may be shaped in a manner that allows a user to easily grip it. One side of the handle grip may have a pivot unit pivotably installed in the handle base, and the other side of the handle grip may include a grip lever connected to the base lever of the handle base.

Based on this structure, when a user pulls the handle grip while gripping the handle grip, the handle grip pivots around the pivot unit; the grip lever of the handle grip rotates the base lever of the handle base; and the operation cable is pulled by the rotation of the base lever to unlock the door-locking mechanism such that the vehicle door may be opened.

Meanwhile, in the event of a side collision of the vehicle, inertial force may occur in the base lever in the direction of pulling the handle grip, but the opening of the vehicle door may be prevented as the balance weight provides an inertial force of the opposite direction.

However, the conventional balance weight used in vehicle door handles has a different weight or size according to the type of vehicle, and thus, it is difficult to create a common balance weight.

In addition, in the conventional outside handle for vehicle door, when the handle grip returns to the original position after the opening of the door, the handle grip strikes the panel of the vehicle door due to the spring force of the base lever, creating an unpleasant sound.

SUMMARY OF THE INVENTION

The present disclosure has been made in view of the above problems, and provides a vehicle door handle designed to prevent the vehicle door from opening in the event of a collision, and in particular, a side collision, and minimizing the sound that occurs when the outside handle returns to a closed original position.

In an example embodiment, a vehicle door handle includes: a handle base having a rotatable base lever; and a handle grip connected to the handle base, wherein the base lever includes a shaft and a damping unit attached to the shaft, and wherein the damping unit is configured to dampen the rotation speed of the shaft. The damping unit includes a housing filled with a viscous fluid, and a vane member disposed in an interior of the housing and coupled to the shaft. The vane member includes a cylindrical part coupled to a mount on the shaft, and at least one vane extended radially from an outer peripheral surface of the cylindrical part. An edge of the vane is in contact with or in close proximity to an inner peripheral surface of the housing. One or more grooves are formed in the edge of the vane. The housing is formed of a hollow cylinder with an opening in one end portion, and a cap fixed to the opening of the housing. A fixed bracket is disposed on an outer surface of the housing, and is fixed to the handle base.

BRIEF DESCRIPTION OF THE DRAWINGS

The objects, features and advantages of the present disclosure will be more apparent from the following detailed description in conjunction with the accompanying drawings, in which.

DETAILED DESCRIPTION OF EXEMPLARY EMBODIMENTS

Example embodiments of the present disclosure are described with reference to the accompanying drawings in detail. The same reference numbers are used throughout the drawings to refer to the same or like parts. Detailed descriptions of well-known functions and structures incorporated herein may be omitted to avoid obscuring the subject matter of the present disclosure. Other example embodiments or features may further be utilized, and other changes may be made, without departing from the scope of the subject matter presented herein. The example embodiments described herein are not meant to be limiting. Thus, aspects of the present disclosure, as generally described herein and illustrated in the figures, can be arranged, substituted, combined, separated and designed in a wide variety of different configurations, all of which are explicitly contemplated herein.

Figure 5:
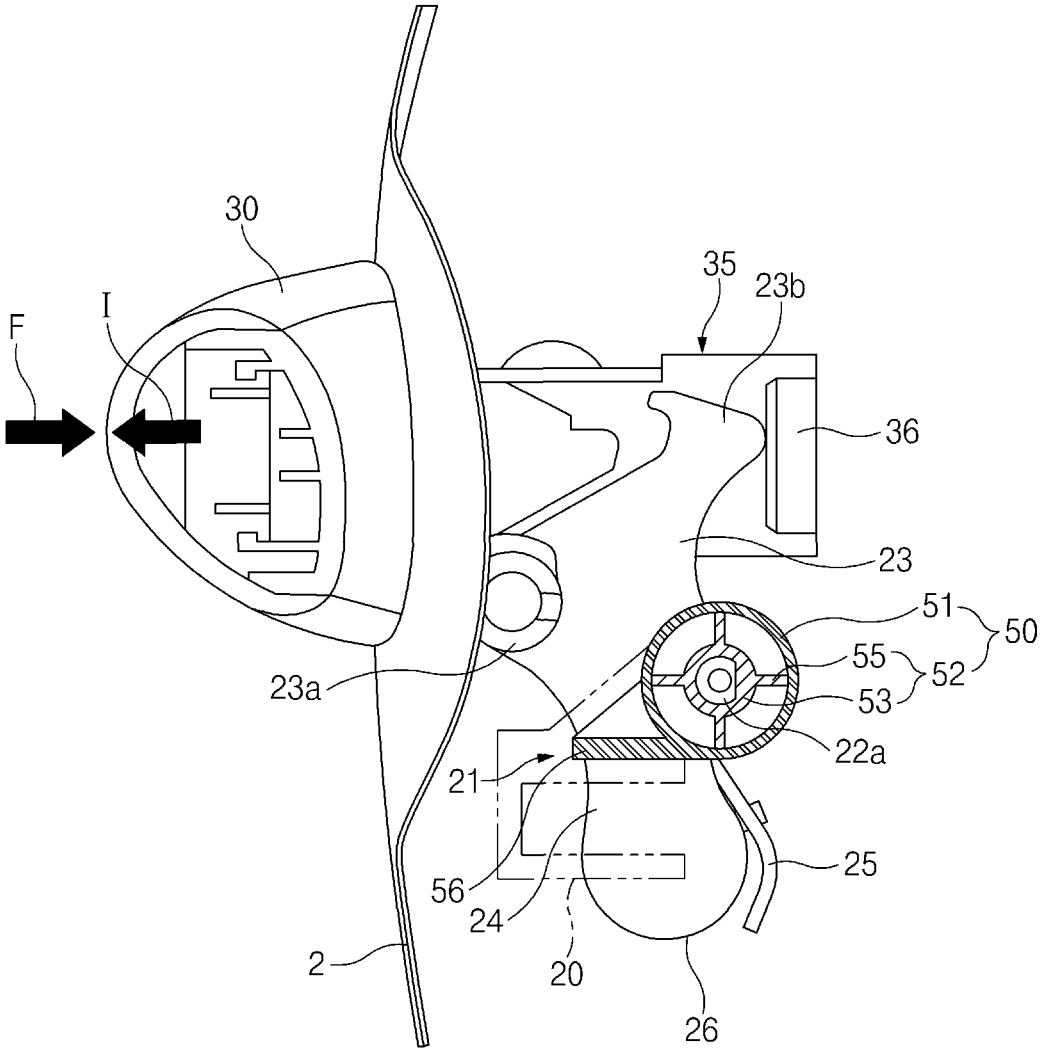
FIG. 5 illustrates an example vehicle door handle in a closed position.
Figure 6:
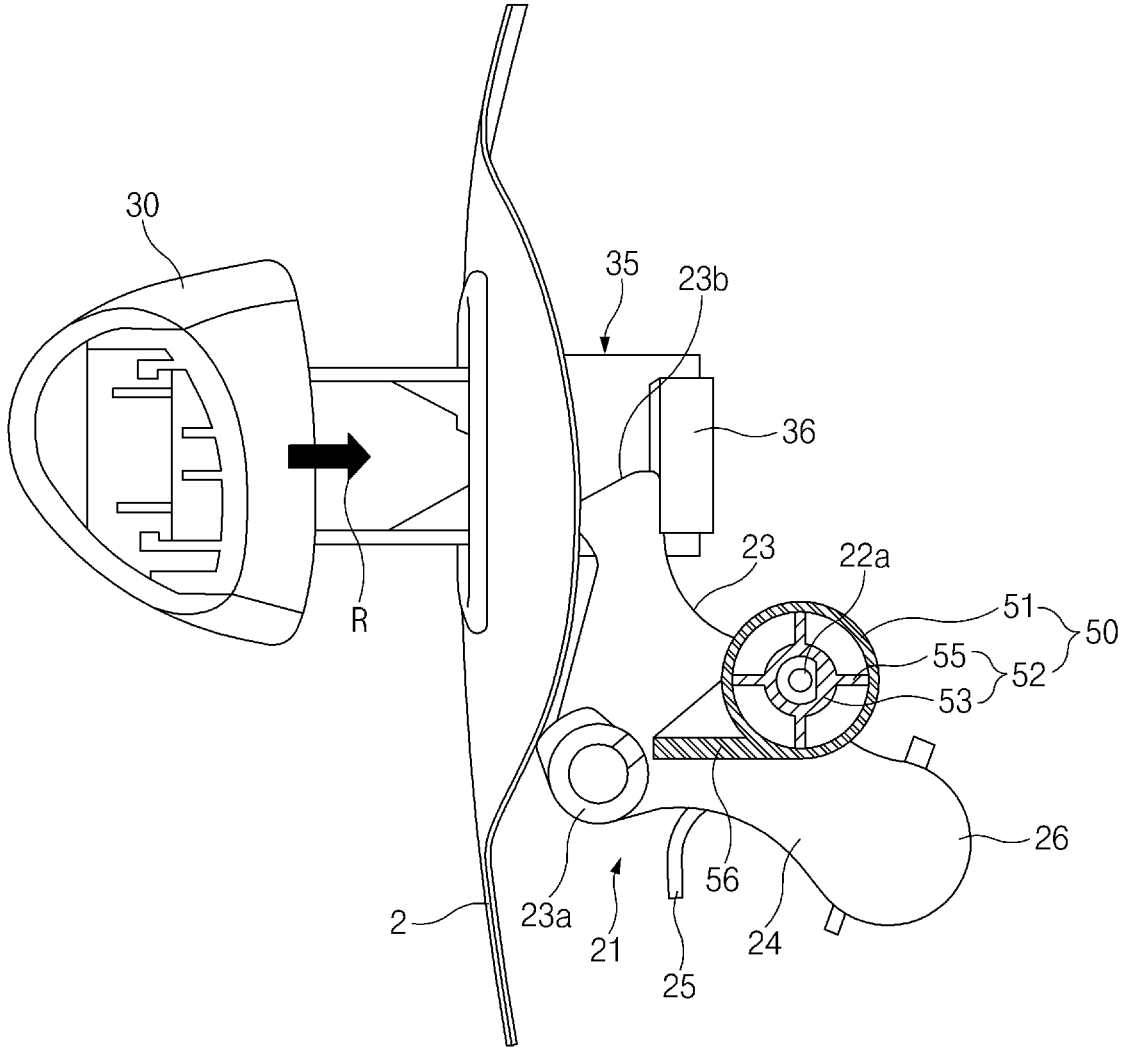
FIG. 6 illustrates an example vehicle door handle in an open position.

As shown in FIG. 5 and FIG. 6, an example vehicle door handle includes a handle base 20 installed in a panel 2 of a vehicle door, and a handle grip 30 pivotably attached to handle base 20. Handle base 20 may be fixed in panel 2, as shown in FIG. 5 and FIG. 6. A base lever 21 may be rotatably installed in handle base 20.

In the example vehicle door handle of FIG. 5 and FIG. 6, base lever 21 includes a shaft 22 rotatably connected to handle base 20, a first lever section extending in one direction from the shaft 22, and a second lever section 24 extending in an opposite direction from the shaft 22.

Shaft 22 may be removably inserted through a return spring 25, which causes base lever 21 to return to its original position when a pulling force (operating force) applied to the handle grip 30 is released.

Figure 3:
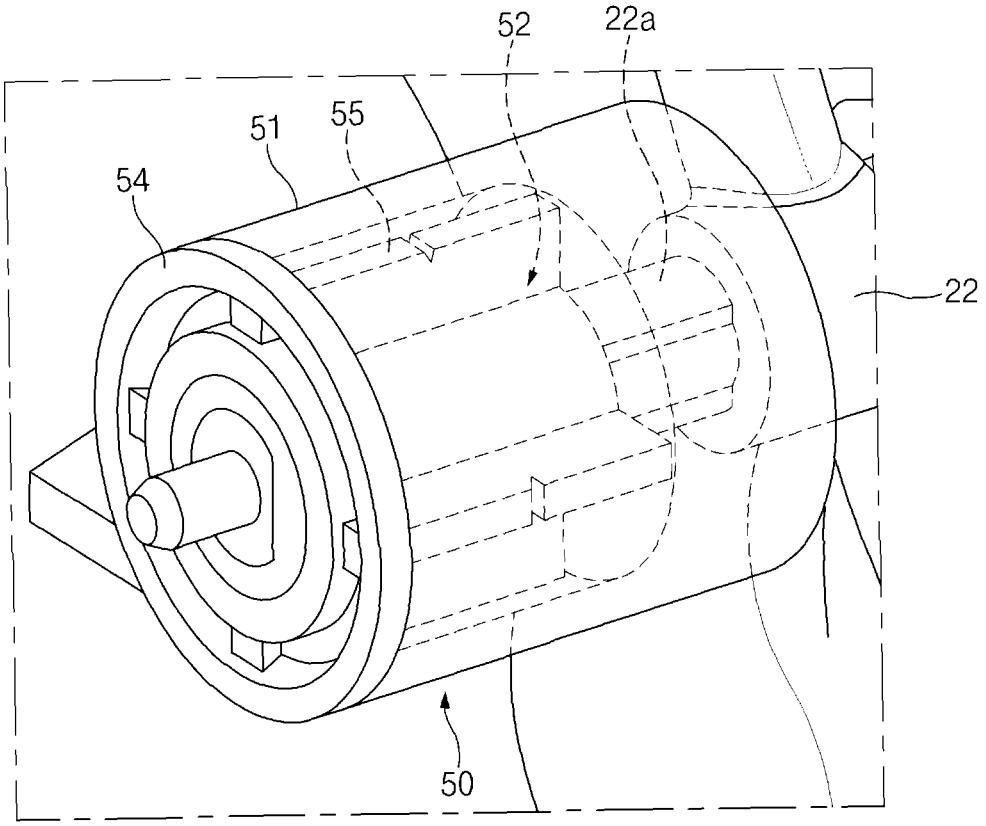
FIG. 3 is a further enlarged view of a section of the example vehicle door handle shown in FIG. 1 illustrating a damping unit including a housing.
Figure 4:
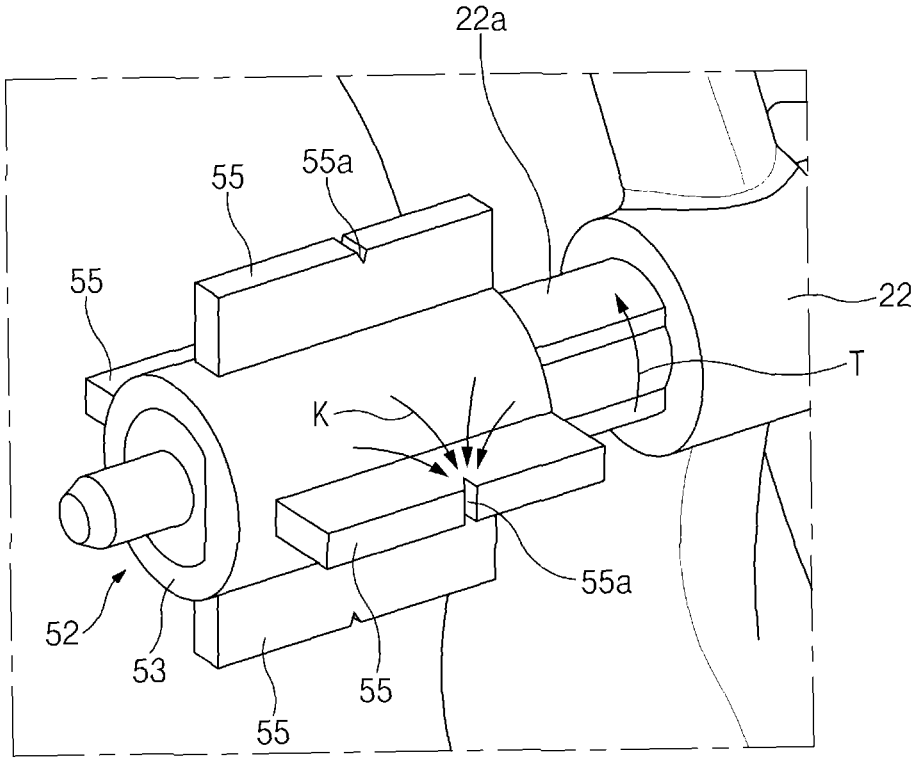
FIG. 4 is a further enlarged view of a section of the example vehicle door handle shown in FIG. 1 illustrating the damping unit with the housing removed.

As shown in greater detail in FIGS. 3 and 4, damping unit 50 may be mounted to shaft 22, and may be configured to dampen the rotation speed of shaft 22 when it rotates in either direction. A mount 22*a* for mounting damping unit 50 may be extended from one end of shaft 22. In the example shown in FIG. 3, the diameter of mount 22*a* is smaller than the diameter of shaft 22. The configuration of the mount and damping unit minimizes interference with other components adjacent to shaft 22.

Damping unit 50 may include a housing 51. Housing 51 may be filled with a viscous fluid, such as high-viscosity silicone oil. A vane member 52 is removably coupled to shaft 22 and disposed in the interior of housing 51.

In the example embodiment in FIGS. 3 and 4, housing 51 is a hollow cylinder with an opening in one end of the cylinder. A cap 54 may be fixed to the opening of the housing 51 through laser welding or other methods.

A fixed bracket 56 may be disposed on the outer surface of the housing 51, and fixed to one side of the handle base 20. Fixed bracket 56 may be integral with housing 51.

In the embodiment shown in FIG. 4, vane member 52 includes a cylindrical part 53 coupled to mount 22*a* of shaft 22, and one or more vanes 55 extending radially from the outer peripheral surface of cylindrical part 53. Vane member 52 may be rotated with shaft 22 in the same direction.

The interface between cylindrical part 53 of vane member 52 and mount 22*a* may take on a variety of configurations designed to prevent slippage during rotation. These configurations may include a chamfered interface, a key interface, a spline interface, and a serrated interface, among others. Preventing slippage of cylindrical part 53 in the circumferential direction of mount 22*a*, allows the rotational force of shaft 22 to be smoothly transmitted to cylindrical part 53.

The number of vanes 55 disposed on the outer surface of vane member 52 may be adjusted to optimize resistance between the viscous fluid disposed in housing 51 and vane member 52. In the example shown in FIG. 3 and FIG. 4, damping force is optimized with four vanes 55.

Each vane 55 includes an edge distal to point of attachment to cylindrical portion 53. The distal edge of each vane may be in contact with, or in close proximity to, an inner peripheral surface of the housing 51.

At least one groove 55*a* may be formed in the distal edge of each vane 55. In the example shown in FIG. 4, groove 55*a* is formed in a "V" shape. The viscous fluid inside the housing passes through groove 55*a* when vane member 52 rotates with the shaft 22. As shown in FIG. 4, the viscous fluid passed through the groove 55*a* flows in the opposite direction (see K direction in FIG. 4) of the rotation direction (see T direction in FIG. 4). Restricted flow of the viscous fluid through the grooves 55*a* applies resistance in the rotational direction of vane member 52. The resistance buffers the rotation of shaft 22.

Figure 2:
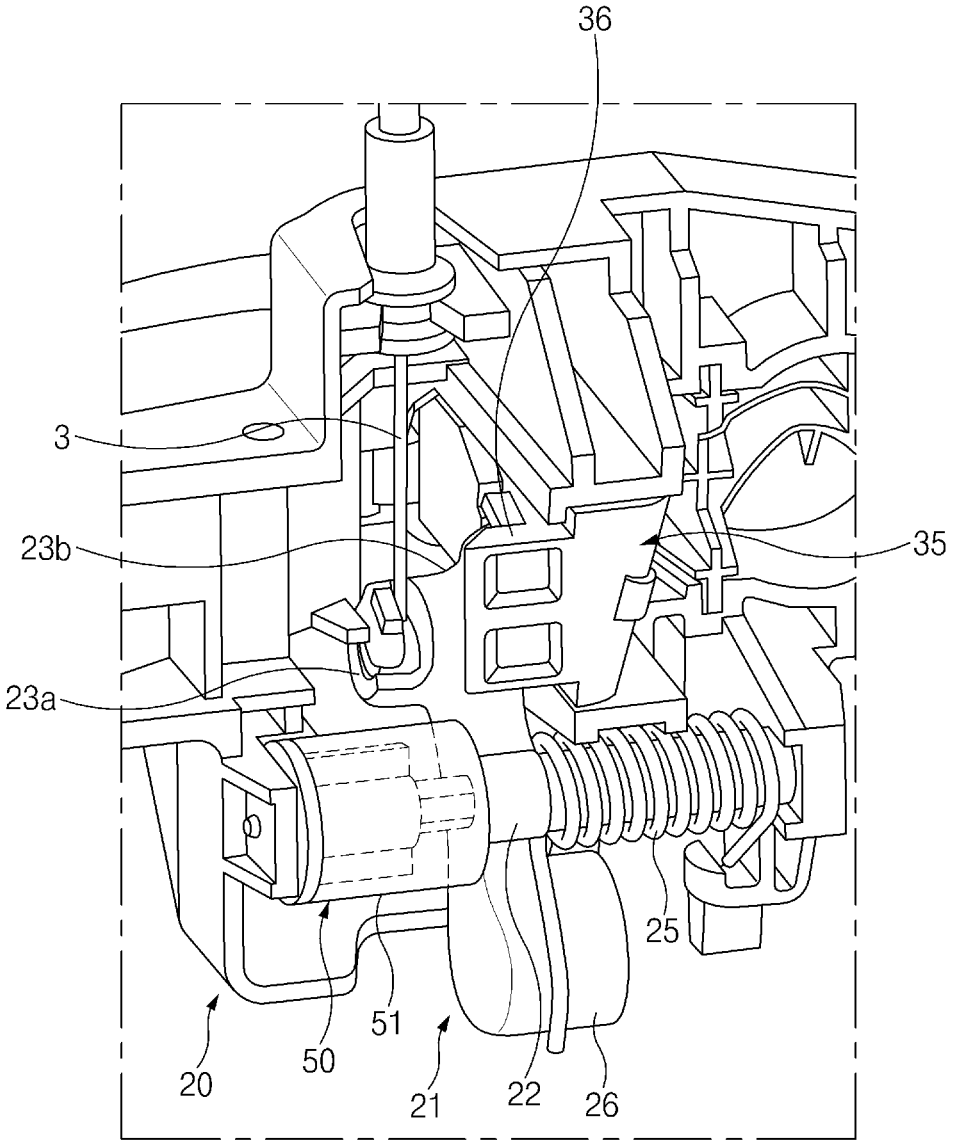
FIG. 2 is an enlarged view of a section of the example vehicle door handle shown in FIG. 1 illustrating a base lever of the vehicle door handle.

As shown in the example of FIG. 2, first lever section 23 includes a coupling section 23*a*. A cable 3 extends between coupling section 23*a* and a latch of a door-locking mechanism (not shown). When base lever 21 rotates in the opening direction of the vehicle door due to the a pulling force being exerted on handle grip 30, cable 3 is pulled causing the latch of the locking mechanism to unlock and allowing the vehicle door to be opened.

First lever section 23 may further include a contact part 23*b* contactable with a stopper 36 of a grip lever 35 of the handle grip 30. According to one example, contact part 23*b* may remain in contact with stopper 36 of grip lever 35, and grip lever 35 of handle grip 30 may cooperate with base lever 21 through contact part 23*b* and stopper 36.

Second lever section 24 may further comprise a balance weight 26 for stably maintaining the rotational position of base lever 21.

The combination of coupling part 23*a* and contact part 23*b* in first lever section 23 and balance weight 26 in the second lever section 24, allows base lever 21 to be rotated in a balanced manner.

Figure 1:
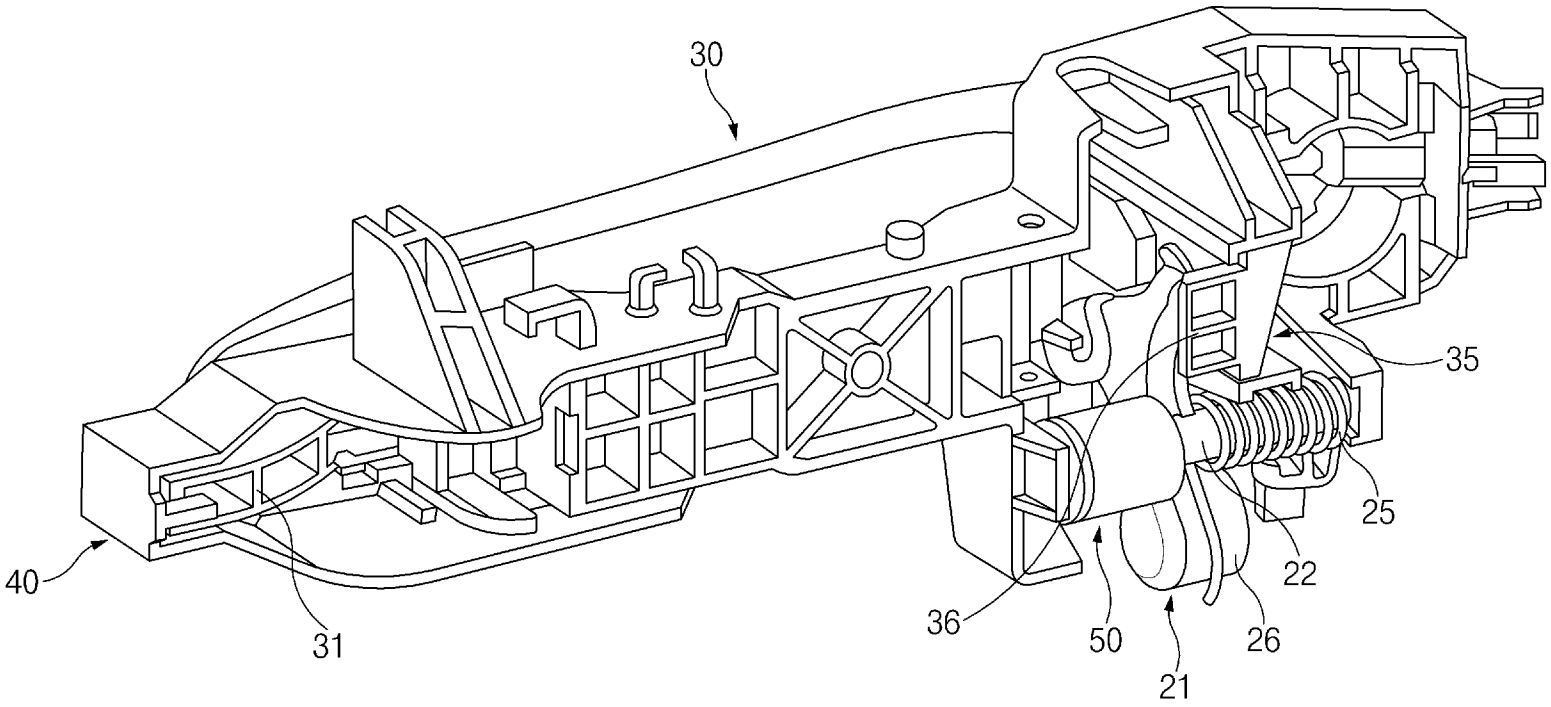
FIG. 1 is a cross-sectional perspective view of an example vehicle door handle.

Handle grip 30 may be disposed in the front side of handle base 20. The shape and material for handle grip 30 may be selected to enable a user to easily grip handle grip 30. As shown in the example in FIG. 1, handle grip 30 may include a pivot part 31 at one end. Pivot part 31 is pivotally attached to one side of handle base 20. Handle grip 30 may further comprise a grip lever 35. Grip lever 35 may be positioned at the opposite end of handle grip 35 from pivot part 31. Handle grip 30 may be arranged to cooperate with base lever 21.

Stopper 36 contactable with contact part 23*b* of base lever 21 may be bent so as to be positioned in the end of grip lever 35.

The operation of an example embodiment having the above described structure is as follows.

If a user grips and pulls handle grip 30, as shown in FIG. 6, stopper 36 of grip lever 35 of handle grip 30 pulls contact part 23*b* of base lever 21 to the inner side of panel 2, thereby causing shaft 22 of base lever 21 to rotate in a first direction. This allows coupling part 23*a* of base lever 21 to move to one side, and cable 3 coupled to coupling part 23*a* may unlock the latch (not shown) of the door-locking mechanism, thereby allowing the vehicle door to open.

When the user releases the force applied to handle grip 30, shaft 22 of base lever 21 rotates in the other direction due to the restoring force of the return spring 25, so that shaft 22 is returned to its original position, as shown in FIG. 5. Because contact part 23*b* of base lever 21 pushes stopper 36 of grip lever 35 away from the inner side of panel 2 due to the return of shaft 22 to its original position, handle grip 30 may be returned to its original position. At the same time, coupling part 23*a* of base lever 21 moves to the inner side of the panel 2, and cable 3 coupled to coupling part 23*a* returns to its original position such that the latch (not shown) of the door-locking mechanism may be locked, thereby keeping the vehicle door closed.

When a vehicle experiences a side collision (see the direction of arrow F in FIG. 5) with the vehicle door closed (i.e. where handle grip 30 of FIG. 5 is returned to the original position), handle grip 30 generates inertial force in a direction away from vehicle door, (i.e., in the direction of pulling the handle grip 30; see the direction of arrow I in FIG. 5).

The external impact force at the time of a side collision may have an acceleration value corresponding to about 200 G within a very short period of time (e.g., within 8 ms). A corresponding inertial force on the handle grip 30 may cause base lever 21 to rotate rapidly, so that vane member 52 of damping unit 50 rotates at a high speed. However, the viscous fluid in housing 51 causes resistance to the rotation of the vane member 52, thereby damping the rotation speed of vane member 52 and shaft 22 of base lever 21.

In particular, according to an example embodiment, the damping effect resulting from resistance to the flow of the viscous fluid as it passes through groove 53*a* of vane 53 is sufficient to prevent rotation of base lever 21. This blocks the movement of cable 3, thereby preventing the latch of the door-locking mechanism from unlocking, and thus the vehicle door from opening.

After handle grip 30 is pulled, as shown in FIG. 6, when handle grip 30 is released, shaft 22 rotates in the other direction (clockwise in FIG. 6) due to the restoring force of return spring 25, so that base lever 21 returns to the original closed position of FIG. 5, and handle grip 30 moves in the return direction (see the direction of arrow R in FIG. 6). In prior art handles, release of a handle grip 30 may result in the handle grip striking the door panel 2 causing an unpleasant striking noise. According to the present disclosure, the damping force generated by resistance of the viscous fluid against opposes the restoring force of the return spring 25, reducing the rotation speed of vane member 52 and shaft 22 and preventing the handle grip from closing with sufficient force to cause a striking noise. In a preferred example embodiment, vane member 52 comprises four vanes 53 so as to provide sufficient damping force against the restoring force of the return spring 26 and the external impact force.

Thus, the vehicle door handle, as described through its various embodiments above, effectively utilizes the damping force generated by resistance to the flow of the viscous fluid to prevent the vehicle door from opening in the event of a side collision and to minimize an undesirable sound that occurs when the door handle returns to an original closed position.

Although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. A handle for a vehicle door comprising:

a handle base having a rotatable base lever; and a handle grip pivotably attached to the handle base, the handle grip having a grip lever configured to cooperate with the base lever, the grip lever being separated from the base lever;

wherein the base lever comprises a shaft rotatably connected to the handle base, a first lever section extending in one direction from the shaft, a second lever section extending in an opposite direction from the shaft, and a damping unit coupled to the shaft, and wherein the damping unit dampens the rotation speed of the shaft;

wherein the first lever section includes a contact part;

wherein the second lever section includes a balance weight for stably maintaining the rotational position of the base lever; and wherein the grip lever has stopper contacting the contact part of the first lever section;

wherein the shaft, the first lever section, the second lever section, the contact part, and the balance weight are formed as a unitary one-piece structure.

2. The handle of claim 1, wherein the damping unit comprises:

a housing filled with a viscous fluid; and a vane member disposed in the housing and coupled to the shaft.

3. The handle of claim 2, wherein the vane member comprises:

a cylindrical part coupled to a mount on the shaft; and at least one vane extending radially from an outer peripheral surface of the cylindrical part.

4. The handle of claim 3, wherein an edge of the vane is in contact with or in close proximity to an inner peripheral surface of the housing.

5. The handle of claim 3, wherein the vane further comprises at least one groove formed in the edge of the vane.

6. The handle of claim 2, wherein the housing comprises a hollow cylinder having an opening formed in one end portion, and a cap is fixed to the opening of the housing.

7. The handle of claim 6, wherein the housing further comprises a fixed bracket on an outer surface of the housing, and wherein the fixed bracket is fixed to the handle base.

* * * * *